United States Patent [19]

Jariwala

[11] 3,978,367

[45] Aug. 31, 1976

[54] CATHODE RAY TUBE SECOND ELECTRODE HAVING RECTANGULAR PROJECTING RIDGE

[75] Inventor: Praveen K. Jariwala, Hammondsport, N.Y.

[73] Assignee: Westinghouse Electric Corporation, Pittsburgh, Pa.

[22] Filed: Feb. 27, 1975

[21] Appl. No.: 553,723

[52] U.S. Cl. ..... 313/449

[51] Int. Cl.[2] ..... H01J 29/46; H01J 29/62

[58] Field of Search ..... 313/449, 458, 460, 414, 313/412, 409, 441, 448

[56] References Cited

UNITED STATES PATENTS

| | | | |
|---|---|---|---|
| 3,678,320 | 7/1972 | Barten | 313/412 |
| 3,771,002 | 11/1973 | Standaart | 313/414 X |
| 3,772,554 | 11/1973 | Hughes | 313/412 |
| 3,852,608 | 12/1974 | Johanns et al. | 313/449 |

*Primary Examiner*—Robert Segal
*Attorney, Agent, or Firm*—W. G. Sutcliff

[57] ABSTRACT

A color television picture tube electron gun with an astigmatic lens element formed as an integral part of the second electrode. The astigmatic lens is a rectangularly configured ridge formed in the end closure surface of the second electrode, about a centralized circular aperture. The dimensions are selected to optimize the electron beam configuration impinging upon the screen of the picture tube with the beam being elongated a predetermined amount in the direction normal to the raster sweep direction.

3 Claims, 4 Drawing Figures

CATHODE RAY TUBE SECOND ELECTRODE HAVING RECTANGULAR PROJECTING RIDGE

BACKGROUND OF THE INVENTION

The present invention relates to color television picture tube electron guns. The electron gun generates an electron beam which is directed and accelerated by an electrostatic field. The electron beam impinges the luminescent elements which make up the picture tube screen. A conventional picture tube utilizes a horizontally sweeping electron beam raster, and this regular periodic raster beam should go visually undetected in order to minimize viewer distraction with the entire image formed on the screen. The regularity of the raster can give rise to optical interference patterns. It is known that an astigmatic electron lens can be used to alter and shape the electron beam area which impinges the phosphor screen to minimize optical distractions. Such an astigmatic lens is taught in U.S. Pat. No. 3,852,608 in which the electron beam is elongated in the direction normal to the raster sweep direction.

The astigmatic element is described as two plates, which are segments of a circle which are attached to the end closure portion of the second electrode of the electron gun. The plates are disposed on the side of the end closure facing the third electrode. The plates define an elongated passage about a centralized beam admitting aperture in the second electrode end closure. Such plates require a separate fabrication and assembly operation. The reference patent also teaches a unitary second electrode astigmatic lens in another embodiment, in which the end closure of the second electrode is provided with an elongated bulge formed in the end closure of the second electrode. The elongated bulge extends toward the first electrode.

BRIEF DESCRIPTIONS OF THE DRAWINGS

DESCRIPTION OF THE PREFERRED EMBODIMENT

Figure 1:
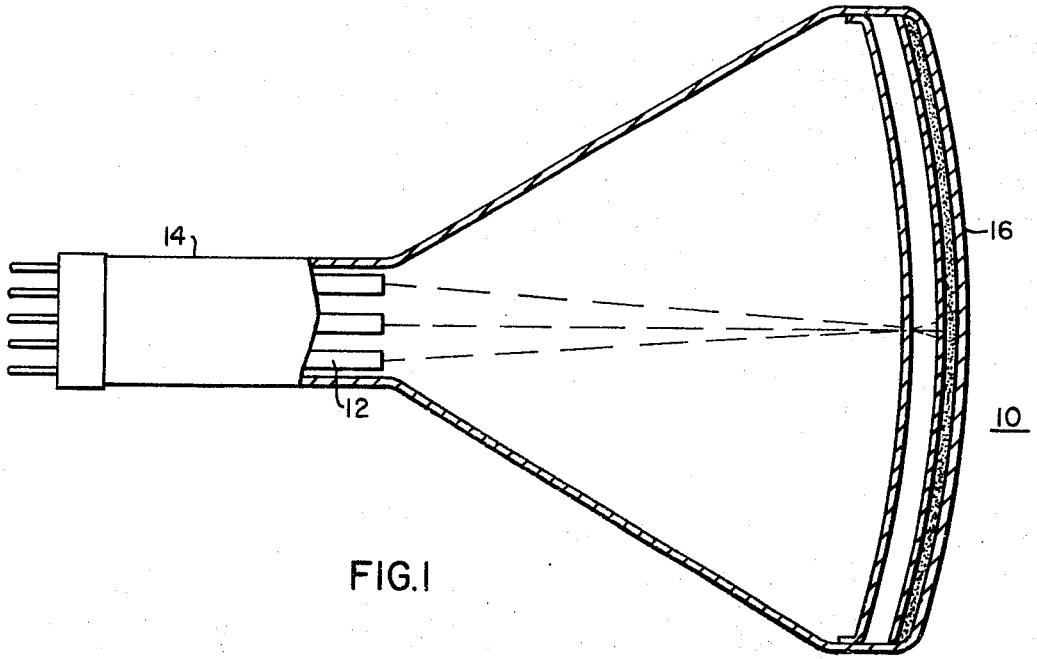
FIG. 1 is a schematic representation of a color television picture tube.

The color television cathode ray picture tube 10 shown in FIG. 1, employs three electron guns 12 disposed in the neck portion 14 of the tube 10 to produce the luminescent display on screen portion 16 as is well understood.

Figure 2:
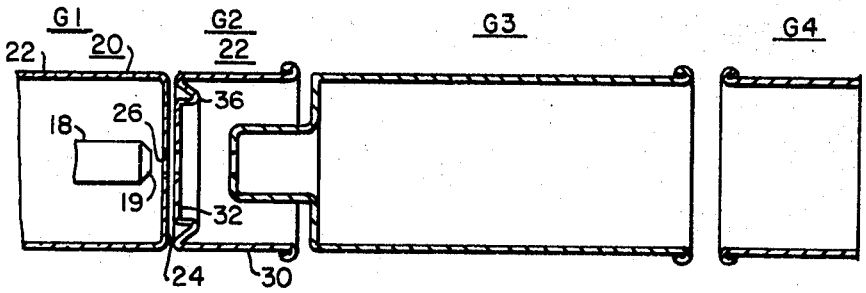
FIG. 2 is an enlarged view partly in section of a portion of the electron gun structure per the invention.

The electron guns 12 are preferably disposed in a delta array, as are the individual phosphor elements on the screen as is well known. A partial view of a single electron gun 12 is seen in FIG. 2, and only those elements which are improved per the present invention will be explained in detail since the general gun structure is otherwise conventional.

Figure 4:
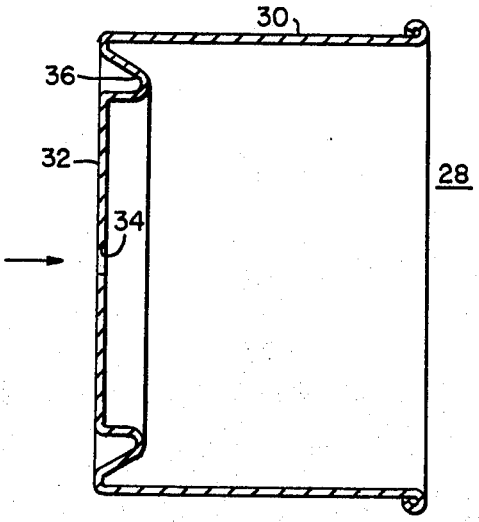
FIG. 4 is a view in section taken along line 4—4 of FIG. 3 to show the improved grid structure of the present invention.
Figure 3:
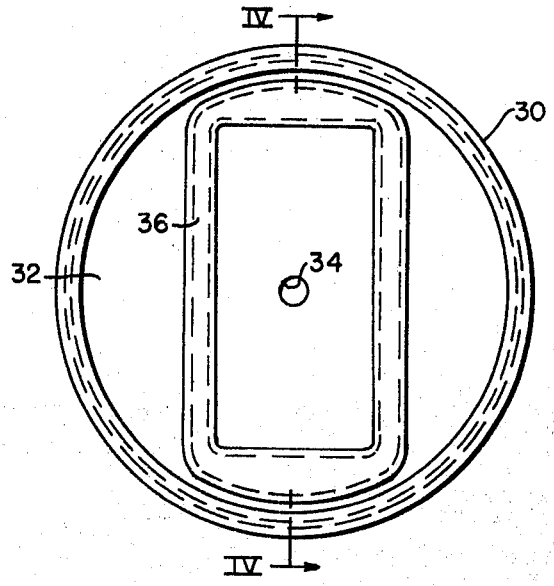
FIG. 3 is a view looking into the second grid showing the improved grid structure.

The electron gun 12 comprises an indirectly heated cathode 18, having an emissively coated end surface 19 from which the electron beam eminates. A first electrode 20 comprises a generally cylindrical body 22, with an end closure portion 24 having a centralized circular aperture 26 therethrough along the electron beam axis. A second electrode 28 is adjacent to the first electrode 20 but spaced therefrom, again along the electron beam axis. The second electrode 28 seen in greater detail in FIGS. 3 and 4, also comprises a cylindrical body portion 30, and an end closure portion 32 having a centralized circular aperture 34 therethrough. The second electrode 28 is oriented with the end closure portion 32 proximate the first electrode, with apertures 26 and 34 aligned for passage of the electron beam.

A third electrode 38 disposed adjacent the second electrode, and includes a reduced diameter cylindrical portion 40 with an end closure surface 42 and an electron beam aperture 44 aligned along the electron beam axis. The third electrode also includes an increased diameter portion 46. A fourth cylindrical electrode is also typically employed, and this is the high voltage electrode of the gun.

A generally rectangular configured projecting ridge 36 is formed in the end closure portion 32 of the second electrode 28. The ridge 36 is formed symmetrical about the aperture 34, and functions as an astigmatic electron lens to produce an elongation of the electron beam in the same direction of elongated side of the rectangular ridge 36. The electron gun is oriented in the picture tube so that the elongated side of the rectangular ridge is oriented with the vertical axis of the tube.

By way of example, the inside diameter of the second electrode cylinder is 0.375 inch. The rectangular ridge formed in the end closure surface measuring from the inside edge of the ridge is about 0.230 inch long on the elongated side, and about 0.015 inch long on the short side of the rectangle. The projecting ridge projects about 0.040 inch from the plane of the end closure surface. The projecting ridge contour is such that the interior side wall is substantially normal to the end closure surface and the exterior sloping side of the ridge is at an angle of about 45 degrees with respect to the end closure plane.

The elongated length of the rectangular projecting ridge is generally preferred to be just less than the inside diameter of the second electrode cylinder diameter. The short side dimension of the rectangular projecting ridge can be readily varied to vary the electron beam elongation. For the example specified above, with a ridge of 0.230 by 0.105 inch, the electron beam at the luminescent screen is elongated in the same direction as the rectangular ridge, and the ratio of the major axis to minor axis of the beam at the screen is 1.17.

The electron beam elongation in the picture tube is in a direction normal to the horizontal electron beam raster and will minimize the ability of the viewer to perceive the raster, since the elongated beam will overlap phosphor areas in the vertical direction.

In prior art astigmatic lens the degree of elongation of the beam was greater, and was produced by defining a lens in which the rectangular lens element had a minor axis which was much shorter than is taught herein. The primary factors determining the degree of electron beam elongation are the diameter of the second electrode circular aperture, the minor axis dimension of the rectangular lens elements, and the height of the lens element above the end closure surface.

The present projecting ridge has a minor axis ridge length which exceeds the ridge projection height by greater than 2 to 1, and is preferably 2.6 to 1. The minor axis ridge length exceeds the diameter of the centralized circular aperture in the second electrode end closure by greater than 3 to 1, and is preferably 3.5 to 1.

The end closure surface of the second electrode in the presently described projecting ridge electron gun component remains in the plane which is at the end of the second electrode cylinder. This facilitates spacing of the first electrode and second electrode in fabricating the electron gun.

I claim:

1. An improved electron gun for use in a color television cathode ray tube, which electron gun comprises a cathode from which an electron beam is emitted, at least a first and second electrode disposed along the electron beam path for controlling and accelerating the electron beam, which first control electrode has a centralized aperture therethrough along the electron beam axis, and which second electrode is adjacent the first electrode, and comprises a generally cylindrical side wall portion, and an end closure portion at the end proximate the first electrode, which end closure portion includes a centralized circular aperture therethrough along the electron beam axis, and a rectangular projecting ridge formed in the end closure about the centralized circular aperture, and projecting from the plane of the end closure toward the open end of the second grid, to thereby comprise an astigmatic electron lens which produces an electron beam which is elongated in cross section in the same direction as the rectangular projecting ridge.

2. The electron gun specified in claim 1, wherein the rectangular projecting ridge has a minor ridge length which exceeds the projection height of the ridge by greater than 2 to 1, while the minor ridge length exceeds the diameter of the centralized circular aperture in the second electrode end closure by greater than 3 to 1.

3. The electron gun specified in claim 2, wherein the preferred ratio of minor ridge length to ridge height is 2.6 to 1, while the preferred ratio of minor ridge length to aperture diameter is 3.5 to 1.

* * * * *